US005538664A

United States Patent [19]

Michael

[11] Patent Number: 5,538,664

[45] **Date of Patent: *Jul. 23, 1996**

[54] HARD SURFACE DETERGENT COMPOSITIONS

[75] Inventor: Daniel W. Michael, Cincinnati, Ohio

[73] Assignee: The Procter & Gamble Company, Cincinnati, Ohio

[ * ] Notice: the term of this patent shall not extend beyond the expiration date of Pat. No. 5,290,472.

[21] Appl. No.: 174,728

[22] Filed: Dec. 29, 1993

Related U.S. Application Data

[63] Continuation of Ser. No. 839,649, Feb. 21, 1992, Pat. No. 5,290,472.

[51] Int. Cl.[6] ..... C11D 1/66; C11D 3/20

[52] U.S. Cl. ..... 510/217; 510/238; 510/424; 510/432; 510/437; 510/434; 510/421; 510/393

[58] Field of Search ..... 252/174.21, 174.19, 252/173, 162, 170, 122

[56] References Cited

U.S. PATENT DOCUMENTS

| | | | |
|---|---|---|---|
| H468 | 5/1988 | Malik et al. | 252/542 |
| 3,671,465 | 6/1972 | Murphy | 252/548 |
| 3,882,038 | 5/1975 | Clayton et al. | 252/164 |
| 4,157,921 | 6/1979 | Baturay et al. | 134/4 |
| 4,581,161 | 4/1986 | Nedonchelle | 252/550 |
| 4,627,931 | 12/1986 | Malik | 252/153 |
| 4,692,277 | 9/1987 | Siklosi | 252/558 |
| 4,747,977 | 5/1988 | Whitehead et al. | 252/111 |
| 4,808,235 | 2/1989 | Woodson et al. | 134/22.19 |
| 4,822,854 | 4/1989 | Ciolino | 252/174.19 |
| 4,886,615 | 12/1989 | Dehan | 252/90 |
| 5,035,826 | 7/1991 | Durbat et al. | 252/121 |
| 5,126,068 | 6/1992 | Burke et al. | 252/174.21 |
| 5,290,472 | 3/1994 | Michael | 252/170 |
| 5,350,541 | 9/1994 | Michael et al. | 252/549 |
| 5,382,376 | 1/1995 | Michael et al. | 252/153 |

*Primary Examiner*—Paul Lieberman
*Assistant Examiner*—Michael P. Tierney
*Attorney, Agent, or Firm*—Robert B. Aylor

[57] ABSTRACT

Hard surface detergent compositions comprise nonionic detergent surfactant; tripropylene glycol or short chain alkyl ether of tripropylene glycol as a hydrophobic cleaning solvent; and optional, but preferred suds control system comprising fatty acid and anionic sulfonated and/or sulfated detergent surfactant. The compositions are preferably in the form of aqueous liquids and preferably have monoethanolamine and/or beta-aminoalkanol present. The compositions clean vinyl no-wax flooring without rinsing and without substantial filming/streaking.

18 Claims, No Drawings

HARD SURFACE DETERGENT COMPOSITIONS

This is a continuation of application Ser. No. 07/839,649, filed on Feb. 21, 1992, now U.S. Pat. No. 5,290,472.

FIELD OF THE INVENTION

This invention pertains to detergent compositions for hard surfaces. Such compositions typically contain detergent surfactants, detergent builders, and/or solvents to accomplish their cleaning tasks.

BACKGROUND OF THE INVENTION

The use of hard surface cleaning compositions containing organic water-soluble synthetic detergents, solvents, and, optionally, detergent builders are known. However, such compositions often have spotting/filming characteristics that are not optimum.

An object of the present invention is to provide detergent compositions which provide both (a) good cleaning for all of the usual hard surface cleaning tasks found in the home and (b) preferred spotting/filming characteristics.

SUMMARY OF THE INVENTION

The present invention relates to a hard surface detergent composition, preferably aqueous, comprising: (a) nonionic detergent surfactant; (b) tripropylene glycol, or $C_{1-6}$, preferably $C_4$, alkyl ethers of tripropylene glycol as the hydrophobic solvent that provides a primary cleaning function; (c) optional, but highly preferred, suds control system comprising low level of fatty acid and anionic detergent surfactant; and (d) the balance typically being an aqueous solvent system and minor ingredients, said composition having a pH of from about 6 to about 12.5, preferably from about 7 to about 11.5, more preferably from about 10 to about 11.5, for cleaning and from about 7 to about 9 for mildness. The compositions can also contain, optionally, small amounts of additional surfactants and/or polycarboxylate detergent builders and/or buffering system, especially the alkanolamines described hereinafter, (to maintain the desired pH). The compositions are preferably formulated as concentrates which are diluted to usage concentrations.

DETAILED DESCRIPTION OF THE INVENTION (a) The Nonionic Detergent Surfactant

Nonionic detergent surfactants, provide superior cleaning on oily/greasy soils, and have a sudsing profile that is more optimal than anionic surfactants. If the sudsing profile is too high for optimum acceptance by the consumer, it can be lowered by the suds control system disclosed hereinafter.

The nonionic detergent surfactant provides the main cleaning and emulsifying benefits herein. Nonionic detergent surfactants useful herein include any of the well-known nonionic detergent surfactants that have an HLB of from about 6 to about 18, preferably from about 8 to about 16, more preferably from about 10 to about 14. Typical of these are alkoxylated (especially ethoxylated) alcohols and alkyl phenols, and the like, which are well-known from the detergency art. In general, such nonionic detergent surfactants contain an alkyl group in the $C_{8-22}$, preferably $C_{10-18}$, more preferably $C_{10-16}$, range and generally contain from about 2.5 to about 12, preferably from about 4 to about 10, more preferably from about 5 to about 8, ethylene oxide groups, to give an HLB of from about 8 to about 16, preferably from about 10 to about 14. Ethoxylated alcohols are especially preferred in the compositions of the present type.

Specific examples of nonionic detergent surfactants useful herein include decyl polyethoxylate(2.5); coconut alkyl polyethoxylate( 6.5); and decyl polyethoxylate(6).

A detailed listing of suitable nonionic surfactants, of the above types, for the detergent compositions herein can be found in U.S. Pat. No. 4,557,853, Collins, issued Dec. 10, 1985, incorporated by reference herein. Commercial sources of such surfactants can be found in McCutcheon's EMULSIFIERS AND DETERGENTS, North American Edition, 1984, McCutcheon Division, MC Publishing Company, also incorporated herein by reference.

The nonionic detergent surfactant typically comprises from about 1% to about 15%, preferably from about 2% to about 10%, more preferably from about 2% to about 5%, of the composition. For a typical heavy usage concentration, (1:32 dilution), the level preferably is less than about 5%, more preferably less than about 4%.

(b) The Triorooylene Glycol Hydroohobic Solvents

In order to obtain good cleaning, especially of lipid soils, it is necessary to use a hydrophobic solvent that has cleaning activity. The solvents that are normally employed in hard surface cleaning compositions are the well-known "degreasing" solvents commonly used in, for example, the dry cleaning industry, in the hard surface cleaner industry and the metalworking industry. However, for cleaning surfaces such as tile floors, many of the solvents do not provide optimum spotting/filming characteristics.

The tripropylene glycol ethers of this invention are described in U.S. Pat. No. 3,882,038, Clayton et al., issued May 6, 1975, said patent being incorporated herein by reference. The patent compares many related polypropylene glycol ether solvents in the context of soil removal and product stability, using a built detergent composition used full strength. There is no discussion of filming/streaking properties, and the comparisons appear to suggest an advantage for dipropylene glycol ether solvents as compared to the tripropylene glycol solvents. Applicant has now found that tripropylene glycol and the $C_{1-6}$ alkyl ethers thereof provide improved spotting/filming, as compared to the adjacent dipropylene glycol ether solvents. In order to see this advantage, the level of other ingredients which are detrimental to filming/streaking, such as crystalline inorganic salts and even the essential nonionic detergent surfactant described hereinbefore, must be limited.

The level of tripropylene glycol and/or tripropylene glycol ether solvents and/or other hydrophobic solvent at very low levels, is typically from about 0.5% to about 15%, preferably from about 1% to about 12%, most preferably from about 2% to about 10%.

The preferred tripropylene glycol ethers are the methyl and butyl ethers, preferably the butyl ether. Such solvents are available from Dow Chemical Company, under the trade names Dowanol TPM and Dowanol TPnB. Preferably the hydrophobic solvent is all tripropylene glycol and/or tripropylene glycol ether.

Optionally, other hydrophobic solvents can be present in small amounts. The formulator of compositions of the present type will be guided in the selection of such optional solvents partly by the need to provide good grease-cutting properties, and partly by aesthetic considerations. For example, kerosene hydrocarbons function quite well for grease cutting, but can be malodorous. Kerosene must be exceptionally clean before it can be used, even in small amounts in commercial situations. For home use, where malodors would not be tolerated, the formulator would be more likely to select solvents which have a relatively pleasant odor, or odors which can be reasonably modified by perfuming. The optional solvents can also be hydrocarbon or halogenated hydrocarbon moieties of the alkyl or cycloalkyl type, and have a boiling point well above room temperature, i.e., above about 20° C.

The $C_6$-$C_9$ alkyl aromatic solvents, especially the $C_6$-$C_9$ alkyl benzenes, preferably octyl benzene, exhibit excellent grease removal properties and have a low, pleasant odor. Likewise, the olefin solvents having a boiling point of at least about 100° C., especially alpha-olefins, preferably 1-decene or 1-dodecene, are excellent grease removal solvents.

Generically, other optional glycol ethers useful herein have the formula $R^1 O(R^2O)_mH$ wherein each $R^1$ is an alkyl group which contains from about 4 to about 8 carbon atoms, each $R^2$ is either ethylene or propylene, and m is a number from 1 to 2, and the compound has a solubility in water of less than about 20%, preferably less than about 10%, and more preferably less than about 6%. The most preferred of such other glycol ethers are selected from the group consisting of dipropyleneglycolmonobutyl ether, monopropyleneglycolmonobutyl ether, diethyleneglycolmonohexyl ether, monoethyleneglycolmonohexyl ether, and mixtures thereof.

Any butoxy-propanol solvent that is present should have no more than about 20%, preferably no more than about 10%, more preferably no more than about 7%, of the secondary isomer in which the butoxy group is attached to the secondary atom of the propanol for improved odor. However, normally very little of this solvent is used, so the odor is less important.

Other optional solvents for these hard surface cleaner compositions comprise diols having from 6 to about 16 carbon atoms in their molecular structure, especially diol solvents having a solubility in water of from about 0.1 to about 20 g/100 g of water at 20° C.

Other solvents such as benzyl alcohol, n-hexanol, and phthalic acid esters of $C_{1-4}$ alcohols can also be used.

Terpene solvents and pine oil, are usable, but are preferably not present.

(c) The Optional, but Preferred, Suds Control System (1) The Fatty Acid

The primary suds controlling ingredient is fatty acid containing from about 8 to about 22, preferably from about 10 to about 18, more preferably from about 10 to about 16, carbon atoms. Especially preferred fatty acids are derived from, e.g., coconut oil, palm kernel oil, and animal tallow.

The level of such fatty acid is from about 0.01% to about 0.2%, preferably from about 0.02% to about 0.15%, more preferably from about 0.02% to about 0.1%, for normal concentrations of nonionic detergent surfactant as set forth hereinbefore. Less fatty acid is needed for lower HLB nonionic detergent surfactants and more is needed for higher HLB nonionic detergent surfactants. Preferably the level of fatty acid is kept below about 0.1% in order to maintain superior spotting/filming performance. The ratio of nonionic detergent surfactant to fatty acid typically ranges from about 10:1 to about 120:1, preferably from about 25:1 to about 80:1.

The fatty acid does not control the suds of the nonionic detergent surfactant if it is used alone. Surprisingly, the fatty acid requires the presence of a small amount of anionic synthetic detergent surfactant, preferably a sulfonated or sulfated synthetic detergent surfactant, more preferably a sulfonated detergent surfactant as set forth hereinafter.

(2) The Anionic Sulfated or Sulfonated Detergent Surfactant

Typical anionic sulfated and/or sulfonated detergent surfactants are the alkyl- and alkylethoxylate- (polyethoxylate) sulfates, paraffin sulfonates, alkyl benzene sulfonates, olefin sulfonates, alpha-sulfonates of fatty acids and of fatty acid esters, and the like, which are well known from the detergency art. In general, such detergent surfactants contain an alkyl group in the $C_9$-$C_{22}$, preferably $C_{10-18}$, more preferably $C_{12-16}$, range. The anionic detergent surfactants can be used in the form of their sodium, potassium or alkanolammonium, e.g., triethanolammonium salts. $C_{12}$-$C_{18}$ paraffinsulfonates and $C_{9-15}$ alkyl benzene sulfonates are especially preferred in the compositions of the present type. Although alkyl sulfates are not very efficient, alkyl ethoxylate sulfates are relatively efficient.

A detailed listing of suitable anionic detergent surfactants, of the above types, for the detergent compositions herein can be found in U.S. Pat. No. 4,557,853, Collins, issued Dec. 10, 1985, incorporated by reference hereinbefore. Commercial sources of such surfactants can be found in McCutcheon's EMULSIFIERS AND DETERGENTS, North American Edition, 1984, McCutcheon Division, MC Publishing Company, also incorporated hereinbefore by reference.

The anionic detergent cosurfactant component is typically present at a level of from about 0.1% to about 2.5%, more preferably from about 0.25% to about 1%. Anionic detergent surfactants are desirably present only in limited amounts to maintain good rinsing properties.

It has been surprisingly found that the ratio of anionic surfactant to fatty acid is particularly critical in the control of sudsing. Preferably the ratio of anionic surfactant to fatty acid ranges from about 15:1 to about 5:1, more preferably the ratio lies between about 12:1 and about 7:1.

(d) Optional Alkanolamine, Preferably Monoethanolamine and/or Beta-aminoalkanol, pH Buffer Alkanolamines are highly preferred as alkaline buffers, especially those that are volatile and/or non-crystalline at room temperature. The alkanolamines serve primarily as solvents when the pH is above about 10, and especially above about 10.7. They also provide alkaline buffering capacity during use. The alkanolamines improve the spotting/filming properties of hard surface cleaning compositions as compared to conventional alkalinity sources such as carbonates, bicarbonates, phosphates, etc.

The preferred alkanolamines are monoethanolamine and/or beta-alkanolamine. The alkanolamines, when present, are used at a level of from about 0.05% to about 10%, preferably from about 0.2% to about 5%. For compositions which are sufficiently dilute to use full strength, they are typically present at a level of from about 0.05% to about 2%, preferably from about 0.1% to about 1%, more preferably from about 0.2% to about 0.7%. For concentrated compositions they are typically present at a level of from about 0.5% to about 10%, preferably from about 1% to about 5%.

Preferred beta-aminoalkanols have a primary hydroxy group. Suitable beta-aminoalkanols have the formula:

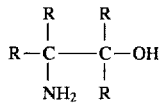

wherein each R is selected from the group consisting of hydrogen and alkyl groups containing from one to four carbon atoms and the total of carbon atoms in the compound is from three to six, preferably four. The amine group is preferably not attached to a primary carbon atom. More preferably the amine group is attached to a tertiary carbon atom to minimize the reactivity of the amine group. Specific preferred beta-aminoalkanols are 2-amino,1-butanol; 2-amino,2-methylpropanol; and mixtures thereof. The most preferred beta-aminoalkanol is 2-amino,2-methylpropanol since it has the lowest molecular weight of any beta-aminoalkanol which has the amine group attached to a tertiary carbon atom. The beta-aminoalkanols preferably have boiling points below about 175° C. Preferably, the boiling point is within about 5° C. of 165° C.

Such beta-aminoalkanols are excellent materials for hard surface cleaning in general and, in the present application, have certain desirable characteristics.

Polar solvents with only minimal cleaning action like methanol, ethanol, isopropanol, ethylene glycol, propylene glycol, and mixtures thereof are usually not present. When the non-aqueous polar solvent is present, its level is from about 0.5% to about 10%, preferably less than about 5% and the level of water is from about 50% to about 97%, preferably from about 75% to about 95%.

(e) Other Optional Ingredients

The compositions herein can also contain other various adjuncts which are known to the art for detergent compositions so long as they are not used at levels that cause unacceptable spotting/filming. Non-limiting examples of such adjuncts are:

Low levels of other detergent surfactants, e.g., zwitterionic detergent surfactants, and detergent builders;

Enzymes such as proteases;

Hydrotropes such as sodium toluene sulfonate, sodium cumene sulfonate and potassium xylene sulfonate; and Aesthetic-enhancing ingredients such as colorants and perfumes, providing they do not adversely impact on spotting/filming. The perfumes are preferably those that are more volatile to minimize spotting and filming.

Zwitterionic Detergent Surfactants

Zwitterionic detergent surfactants contain both cationic and anionic hydrophilic groups on the same molecule at a relatively wide range of pH's. The typical cationic group is a quaternary ammonium group, although other positively charged groups like sulfonium and phosphonium groups can also be used. The typical anionic hydrophilic groups are carboxylates and sulfonates, although other groups like sulfates, phosphates, etc. can be used. A generic formula for some preferred zwitterionic detergent surfactants is:

$$R\text{-}N^{(+)}(R^2)(R^3)R^4X^{(-)}$$

wherein R is a hydrophobic group; $R^2$ and $R^3$ are each $C_{1-4}$ alkyl, hydroxy alkyl or other substituted alkyl group which can also be joined to form ring structures with the N; $R^4$ is a moiety joining the cationic nitrogen atom to the hydrophilic group and is typically an alkylene, hydroxy alkylene, or polyalkoxy group containing from about one to about four carbon atoms; and X is the hydrophilic group which is preferably a carboxylate or sulfonate group.

Preferred hydrophobic groups R are alkyl groups containing from about 8 to about 22, preferably less than about 18, more preferably less than about 16, carbon atoms. The hydrophobic group can contain unsaturation and/or substituents and/or linking groups such as aryl groups, amido groups, ester groups, etc. In general, the simple alkyl groups are preferred for cost and stability reasons.

A specific "simple" zwitterionic detergent surfactant is 3-(N-dodecyl-N,N-dimethyl)-2-hydroxy-propane-1-sulfonate, available from the Sherex Company under the trade name "Varion HC".

Other specific zwitterionic detergent surfactants have the generic formula:

$$R\text{-}C(O)\text{-}N(R^2)\text{-}(CR_{32})_n\text{-}N(R^2)_2^{(+)}\text{-}(CR^3{}_2)_n\text{-}SO_3^{(-)}$$

wherein each R is a hydrocarbon, e.g., an alkyl group containing from about 8 up to about 20, preferably up to about 18, more preferably up to about 16 carbon atoms, each ($R^2$) is either hydrogen or a short chain alkyl or substituted alkyl containing from one to about four carbon atoms, preferably groups selected from the group consisting of methyl, ethyl, propyl, hydroxy substituted ethyl or propyl and mixtures thereof, preferably methyl, each ($R^3$) is selected from the group consisting of hydrogen and hydroxy groups, and each n is a number from 1 to about 4, preferably from 2 to about 3; more preferably about 3, with no more than about one hydroxy group in any ($CR^3{}_2$) moiety. The R groups can be branched and/or unsaturated, and such structures can provide spotting/filming benefits, even when used as part of a mixture with straight chain alkyl R groups. The $R^2$ groups can also be connected to form ring structures. A detergent surfactant of this type is a $C_{10-14}$ fatty acylamidopropylene(hydroxypropylene)sulfobetaine that is available from the Sherex Company under the trade name "Varion CAS Sulfobetaine".

Other zwitterionic detergent surfactants useful herein include hydrocarbyl, e.g., fatty, amidoalkylenebetaines (hereinafter also referred to as "HAB"). These detergent surfactants have the generic formula:

$$R\text{-}C(O)\text{-}N(R^2)\text{-}(CR^3{}_2)_n\text{-}N(R^2)_2^{(+)}\text{-}(CR^3{}_2)_n\text{-}C(O)O(-)$$

wherein each R is a hydrocarbon, e.g., an alkyl group containing from about 8 up to about 20, preferably up to about 18, more preferably up to about 16 carbon atoms, each ($R^2$) is either hydrogen or a short chain alkyl or substituted alkyl containing from one to about four carbon atoms, preferably groups selected from the group consisting of methyl, ethyl, propyl, hydroxy substituted ethyl or propyl and mixtures thereof, preferably methyl, each ($R^3$) is selected from the group consisting of hydrogen and hydroxy groups, and each n is a number from 1 to about 4, preferably from 2 to about 3; more preferably about 3, with no more than about one hydroxy group in any ($CR^3{}_2$) moiety. The R groups can be branched and/or unsaturated, and such structures can provide spotting/filming benefits, even when used as part of a mixture with straight chain alkyl R groups.

An example of such a detergent surfactant is a $C_{10-14}$ fatty acylamidopropylenebetaine available from the Miranol Company under the trade name "Mirataine BD."

The level of zwitterionic detergent surfactant in the composition is typically very low to avoid oversudsing, e.g., from 0% to about 0.5%, preferably from about 0.02% to about 0.5%, more preferably from about 0.05% to about 0.25%.

POLYCARBOXYLATE DETERGENT BUILDERS

Polycarboxylate detergent builders useful herein, include the builders disclosed in U.S. Pat. No. 4,915,854, Mao et al., issued Apr. 10, 1990, and incorporated herein by reference. Suitable detergent builders preferably have relatively strong binding constants for calcium. Preferred detergent builders include citrates and, especially, builders whose acids have the generic formula:

$$R^5\text{-}[O\text{-}CH(COOH)CH(COOH)]_nR^5$$

wherein each $R^5$ is selected from the group consisting of H and OH and n is a number from about 2 to about 3 on the average.

In addition to the above detergent builders, other detergent builders that are relatively efficient for hard surface cleaners and/or, preferably, have relatively reduced filming/streaking characteristics include those disclosed in U.S. Pat. No. 4,769,172, Siklosi, issued Sep. 6, 1988, and U.S. Pat. No. 5,051,212, Culshaw and Vos, issued Sep. 24, 1991, both of said patents being incorporated herein by reference. Some builders of this type include the chelating agents having the formula:

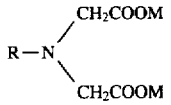

wherein R is selected from the group consisting of:

$-CH_2CH_2CH_2OH$; $-CH_2CH(OH)CH_3$;
$-CH_2CH(OH)CH_2OH$; $-CH(CH_2OH)_2$;

$-CH_3$; $-CH_2CH_2OCH_3$; $-\underset{\underset{O}{\|}}{C}-CH_3$;

$-CH_2-\underset{\underset{O}{\|}}{C}-NH_2$; $-CH_2CH_2CH_2OCH_3$; $-C(CH_2OH)_3$;

and mixtures thereof;
and each M is hydrogen.

Chemical names of the acid form of such chelating agents include:

N(3-hydroxypropyl)imino-N,N-diacetic acid (3-HPIDA);

N(-2-hydroxypropyl)imino-N,N-diacetic acid (2-HPIDA);

N-glycerylimino-N,N-diacetic acid (GLIDA);

dihydroxyisopropylimino-(N,N)-diacetic acid (DHPIDA);

methylimino-(N,N)-diacetic acid (MIDA);

2-methoxyethylimino-(N,N)-diacetic acid (MEIDA);

amidoiminodiacetic acid (also known as sodium amidonitrilotriacetic, SAND);

acetamidoiminodiacetic acid (AIDA);

3-methoxypropylimino-N,N-diacetic acid (MEPIDA); and tris(hydroxymethyl)methylimino-N,N-diacetic acid (TRIDA).

The chelating agents of the invention, when they are present, are at levels of from about 0.2% to about 15.0% of the total composition, preferably from about 0.2% to about 10%, more preferably from about 0.4% to about 5.0%.

The detergent builders can help provide the desired pH in use. However, if necessary, the composition can also contain additional buffering materials to give the desired pH in use. pH is usually measured on the product.

PERFUMES

Most hard surface cleaner products contain some perfume to provide an olfactory aesthetic benefit and to cover any "chemical" odor that the product may have. The main function of a small fraction of the highly volatile, low boiling (having low boiling points), perfume components in these perfumes is to improve the fragrance odor of the product itself, rather than impacting on the subsequent odor of the surface being cleaned. However, some of the less volatile, high boiling perfume ingredients can provide a fresh and clean impression to the surfaces, and it is sometimes desirable that these ingredients be deposited and present on the dry surface. Perfume ingredients are readily solubilized in the compositions by the nonionic detergent surfactants.

The perfume ingredients and compositions of this invention are the conventional ones known in the art. Selection of any perfume component, or amount of perfume, is based solely on aesthetic considerations. Suitable perfume compounds and compositions can be found in the art including U.S. Pat. Nos.: 4,145,184, Brain and Cummins, issued Mar. 20, 1979; 4,209,417, Whyte, issued Jun. 24, 1980; 4,515,705, Moeddel, issued May 7, 1985; and 4,152,272, Young, issued May 1, 1979, all of said patents being incorporated herein by reference.

In general, the degree of substantivity of a perfume is roughly proportional to the percentages of substantive perfume material used. Relatively substantive perfumes contain at least about 1%, preferably at least about 10%, substantive perfume materials.

Substantive perfume materials are those odorous compounds that deposit on surfaces via the cleaning process and are detectable by people with normal olfactory acuity. Such materials typically have vapor pressures lower than that of the average perfume material. Also, they typically have molecular weights of about 200 or above, and are detectable at levels below those of the average perfume material.

Perfume ingredients useful herein, along with their odor character, and their physical and chemical properties, such as boiling point and molecular weight, are given in "Perfume and Flavor Chemicals (Aroma Chemicals)," Steffen Arctander, published by the author, 1969, incorporated herein by reference.

Examples of the highly volatile, low boiling, perfume ingredients are: anethole, benzaldehyde, benzyl acetate, benzyl alcohol, benzyl formate, iso-bornyl acetate, camphene, cis-citral (neral), citronellal, citronellol, citronellyl acetate, paracymene, decanal, dihydrolinalool, dihydromyrcenol, dimethyl phenyl carbinol, eucalyptol, geranial, geraniol, geranyl acetate, geranyl nitrile, cis-3-hexenyl acetate, hydroxycitronellal, d-limonene, linalool, linalool oxide, linalyl acetate, linalyl propionate, methyl anthranilate, alpha-methyl ionone, methyl nonyl acetaldehyde, methyl phenyl carbinyl acetate, laevo-menthyl acetate, menthone, iso-menthone, myrcene, myrcenyl acetate, myrcenol, nerol, neryl acetate, nonyl acetate, phenyl ethyl alcohol, alpha-pinene, beta-pinene, gamma-terpinene, alpha-terpineol, beta-terpineol, terpinyl acetate, and vertenex (para-tertiary-butyl cyclohexyl acetate). Some natural oils also contain large percentages of highly volatile perfume ingredients. For example, lavandin contains as major components: linalool; linalyl acetate; geraniol; and citronellol. Lemon oil and orange terpenes both contain about 95% of d-limonene.

Examples of moderately volatile perfume ingredients are: amyl cinnamic aidehyde, iso-amyl salicylate, beta-caryophyllene, cedrene, cinnamic alcohol, coumarin, dimethyl benzyl carbinyl acetate, ethyl vanillin, eugenol, iso-eugenol, flor acetate, heliotropine, 3-cis-hexenyl salicylate, hexyl salicylate, lilial (para-tertiarybutyl-alpha-methyl hydrocinnamic aidehyde), gamma-methyl ionone, nerolidol, patchouli alcohol, phenyl hexanol, betaselinene, trichloromethyl phenyl carbinyl acetate, triethyl citrate, vanillin, and veratraldehyde. Cedarwood terpenes are composed mainly of alpha-cedrene, beta-cedrene, and other $C_{15}H_{24}$ sesquiterpenes.

Examples of the less volatile, high boiling, perfume ingredients are: benzophenone, benzyl salicylate, ethylene brassylate, galaxolide (1,3,4,6,7,8-hexahydro-4,6,6,7,8,8-hexamethyl-cyclopenta-gama-2-benzopyran), hexyl cinnamic aidehyde, lyral (4-(4 -hydroxy-4-methyl pentyl)-3-cyclohexene-10-carboxaldehyde), methyl cedrylone, methyl dihydro jasmonate, methyl-beta-naphthyl ketone, musk indanone, musk ketone, musk tibetene, and phenylethyl phenyl acetate.

Selection of any particular perfume ingredient is primarily dictated by aesthetic considerations.

It is a special advantage of the compositions of this invention, that perfumes can be incorporated at levels above about 0.2%, and especially above about 0.3%, without causing instability. This is not possible if large amounts, e.g., in excess of about 1%, crystalline inorganic salts are present. Phosphate detergent builders, like tetrapotassium pyrophosphate are especially incompatible. The presence of such builders and/or salts requires the addition of substantial amounts of a hydrotrope for stability. Preferably such inorganic builder salts and/or hydrotropes are not present.

These compositions have exceptionally good cleaning and "shine" properties, i.e., when used to clean glossy surfaces, especially vinyl "no-wax" flooring, e.g., tiles, and especially new flooring, especially without rinsing. The compositions herein, which contain tripropylene glycol, or its ethers, have much less tendency than products containing other hydrophobic cleaning solvents to leave a dull finish on the surface.

The products are typically sold in "concentrated" form for dilution with water in ratios of from about 1:100 to about 1:16, preferably from about 1:64 to about 1:32. The concentration of surfactant and solvent after dilution are, respectively, from about 0.002% to about 0.12%, preferably from about 0.04% to about 0.08%, for the nonionic detergent surfactant and from about 0.03% to about 0.2%, preferably from about 0.05% to about 0.12%, for the tripropylene glycol (including the ethers) solvents. High concentrations of the nonionic detergent surfactant, e.g., levels above about 1%, in use will cause filming/streaking and make the selection of the preferred solvent much less important. When high concentrations are present in the composition, the dilution should be adjusted to give the levels set forth above for use concentrations. The products can also be formulated in more dilute form and packaged in a container that comprises a means for creating a spray, e.g., a pump, aerosol propellant and spray valve, etc.

All parts, percentages, and ratios herein are "by weight" unless otherwise stated. All numerical values are approximations unless otherwise stated.

The invention is illustrated by the following Examples.

EXAMPLES 1–3

| Example No.: Ingredient | 1* Wt. % | 2* Wt. % | 3* Wt. % |
|---|---|---|---|
| Neodol 23-6.5T [$C_{12-13}$ alkyl polyethoxylated (6.5)] | 2.5 | 2.0 | 2.5 |
| Sodium Secondary $C_{13-17}$ Alkane Sulfonate | 0.5 | 0.5 | 0.5 |
| Dipropylene Glycol Monobutyl Ether | 2.5 | — | — |
| Dipropylene Glycol Monomethyl Ether | — | 2.5 | — |
| Tripropylene Glycol Monomethyl Ether | — | — | 2.5 |
| Monoethanolamine | 0.5 | 0.5 | 0.5 |
| Coconut Fatty Acid | 0.06 | 0.06 | 0.0-6 |
| Deionized Water and Minors (e.g., Perfume) | q.s. | q.s. | q.s. |
| pH | 10.8–11.1 | 10.8–11.1 | 10.8–11.1 |

*Comparative Example.

EXAMPLES 4 & 5

| Example No.: Ingredient | 4 Wt. % | 5* Wt. % |
|---|---|---|
| Neodol 23-6.5T [$C_{12-13}$ alkyl polyethoxylated (6.5)] | 2.5 | 2.5 |
| Sodium Secondary ($C_{13-17}$ Alkane Sulfonate | 0.5 | 0.5 |
| Tripropylene Glycol Monobutyl Ether | 2.5 | — |
| Diethylene Glycol Monobutyl Ether | — | 2.5 |
| Monoethanolamine | 0.5 | 0.5 |
| Coconut Fatty Acid | 0.06 | 0.06 |
| Deionized Water and Minors (e.g., Perfume) | q.s. | q.s. |
| pH | 10.8–11.1 | 10.8–11.1 |

*Comparative Example.

The above Examples are tested for filming/streaking properties using the following test procedure.

FILMING/STREAKING TEST

Spondex cellulose sponges are cut to 2×4×1 inches, cleaned of all factory preservatives, rinsed well, and soaked in 110° F. water. One foot square "no wax" floor tiles are cleaned with a mild cleaner and isopropyl alcohol, rinsed with distilled water, and dried with paper towels. The test product is diluted, as indicated, with 110° F. tap water and maintained at that temperature. Fifteen mls. of test solution are placed on a sponge carrier, excess water is squeezed from a sponge and the sponge is placed on the carrier and squeezed to soak up the test solution.

Each tile is divided into two six inches wide vertical sections and the sponge is wiped lightly and slowly over the tile surface, starting at the bottom and wiping up and down two times. Each tile can have two separate test runs. Each product is tested for at least three replications. The tiles are air dried at room temperature for 20 minutes. Expert graders grade the tiles on the scale of: 0–6 where 0= - no visible filming/streaking and 6= very poor filming/streaking. Humidity, temperature and water hardness are recorded for each test. The grades are averaged.

For Examples 1–5, there are 4 replications and three expert graders, the dilution is about 1:32, the humidity is about 26%, the temperature is about 74° F., and the water hardness is about 8 grains ($CaCO_3$). The LSD for this test is 0.45 at the 95% confidence interval. The grades are: 1=2.1; 2=1.5; 3=1.0; 4=0.4; and 5=2.3. Examples 3 and 4 are significantly better than the comparative Examples 1, 2, and 5 at the 95% interval. Example 4 is the very best.

EXAMPLES 6–8

| Example No.: Ingredient | 6 Wt. % | 7 Wt. % | 8* Wt. % |
|---|---|---|---|
| Neodol 23-6.5T [$C_{12-13}$ alkyl poly-ethoxylated (6.5)] | 2.5 | 2.5 | 2.5 |
| Sodium Secondary $C_{13-17}$ Alkane Sulfonate | 0.5 | 0.5 | 0.5 |
| Tripropylene Glycol Monobutyl Ether | 2.5 | — | — |
| Tripropylene Glycol Monomethyl Ether | — | 2.5 | — |
| Dipropylene Glycol Monobutyl Ether | — | — | 2.5 |
| Sodium Citrate Dihydrate | 0.4 | 0.4 | 0.4 |
| Monoethanolamine | 0.5 | 0.5 | 0.5 |
| Coconut Fatty Acid | 0.06 | 0.06 | 0.06 |
| Deionized Water and Minors (e.g., Perfume) | q.s. | q.s. | q.s. |
| pH | 11.0 | 11.0 | 11.0 |

*Comparative Example.

For Examples 6–8, there are four replications and three expert graders, the dilution is about 1:32, the humidity is about the temperature is about 74° F., and the water hardness is about 8 grains. The LSD for this test is 0.82 at the 95% confidence interval. The grades are: 6=1.4; 7=1.0; and 8=2.5. Examples 6 and 7 are significantly better than the comparative Example 8 at the 95% interval. Example 7 is the very best.

EXAMPLES 9 & 10

| Example No.: Ingredient | 9 Wt. % | 10* Wt. % |
|---|---|---|
| Neodol 23-6.5T [$C_{12-13}$ alkyl poly-ethoxylated (6.5)] | 3.0 | 3.0 |
| Sodium Secondary $C_{13-17}$ Alkane Sulfonate | 0.5 | 0.5 |
| Tripropylene Glycol Monobutyl Ether | 2.5 | 0.0 |
| Dipropylene Glycol Monobutyl Ether | 0.0 | 2.5 |
| Monoethanolamine | 0.5 | 0.5 |
| Coconut Fatty Acid | 0.06 | 0.06 |
| Deionized Water and Minors (e.g., Perfume) | q.s. | q.s. |
| pH | 11.0 | 11.0 |

*Comparative Example.

For Examples 9 and 10, there are four replications and three expert graders, the dilution is about 1:32, the humidity is about 21%, the temperature is about 74° F., and the water hardness is about 8 grains. The LSD for this test is 0.71 at the 90% confidence interval. The grades are: 9=2.0 and 10=2.8. Example 9 is significantly better than the comparative Example 10 at the 90% interval.

EXAMPLE 11–13

| Example No.: Ingredient | 11 Wt. % | 12* Wt. % | 13* Wt. % |
|---|---|---|---|
| Neodol 23-6.5T [$C_{12-13}$ alkyl poly-ethoxylate (6.5)] | 2.5 | 2.5 | 2.5 |
| Sodium Secondary $C_{13-17}$ Alkane Sulfonate | 0.5 | 0.5 | 0.5 |
| Tripropylene Glycol Monobutyl Ether | 2.5 | 2.5 | 2.5 |
| Tetrapotassium Pyrophosphate | — | 2.5 | 2.5 |
| Perfume (Citrus Terpene Type) | 0.2 | 0.2 | 0.2 |
| Monoethanolamine | 0.5 | 0.5 | 0.5 |
| Coconut Fatty Acid | 0.06 | 0.06 | 0.06 |
| Deionized Water and Minors | q.s. | q.s. | q.s. |
| pH | 11.0 | 11.6 | 11.0** |

*Comparative Example.
**Hydrochloric Acid added to lower pH to 11.0.

For Examples 11–13, there are four replications and three expert graders, the dilution is about 1:32, the humidity is about the temperature is about 74° F., and the water hardness is about 8 grains. The LSD for this test is 0.82 at the 95% confidence interval. The grades are: 6=1.4; 7= 1.0; and 8= 2.5. Examples 11 is significantly better than the comparative Examples 12 and 13 at the 95% interval. The presence of the pyrophosphate detergent builder, even with dilution, makes the filming/streaking much worse. If the compositions are used at full strength, without rinsing, the filming/streaking is very bad, even for Example 11.

When the perfume level is raised to 0.5% in Examples 11–13, Example 11 is stable, but Examples 12 and 13 become opaque and are aesthetically undesirable to many consumers. At elevated temperatures they are more prone to exhibit phase separation.

What is claimed is:

1. An aqueous liquid hard surface detergent composition having good filming/streaking properties consisting of: (a)detergent surfactant consisting essentially of from about 1% to about 15% of low sudsing nonionic detergent surfactant containing a $C_{8-22}$ alkyl group and from about 2.5 to about 12 ethylene oxide groups to give an HLB of from about 6 to about 18; (b) from about 0.5% to about 1:5% of hydrophobic solvent that provides a cleaning function selected from the group consisting of tripropylene glycol, $C_{1-6}$ ethers of tripropylene glycol, and mixtures thereof, (c) from about 50% to about 97% water; (d) optionally, ingredients selected from the group consisting of from about 0.1% to about 1:5% of a polycarboxylate detergent builder selected from the group consisting of alkali metal citrates, detergent builders that have the formula:

$$H\text{-}[O\text{-}CH(COOH)CH(COOH)]_n R^5$$

wherein $R^5$ is selected from the group consisting of H and OH and n is a number from 2 to about 3 on the average, ned mixtures thereof, zwitterionic detergent surfactant at a level of from about 0.2% to about 0.5%; from about 0,0:5% to about 10% of alkanolamine pH buffer; enzymes; hydrotropes; polar solvent at a level of from about 0.5% to about 10%; colorants; perfume to provide an olfactory aesthetic benefit; and mixtures thereof; and (e) optional suds control system comprising fatty acid and metric detergent surfactant, and when said suds control system is present, the ratio of said nonionic detergent surfactant to said fatty acid being no less than about 25:1 and the ratio of any artionic detergent surfactant to said fatty acid being no more than about 15:1, the pH of said composition being from about 6 to about 12.5 and said composition containing less than about 1% inorganic crystallizable detergent builder material.

2. The composition of claim 1 wherein said nonionic detergent surfactant is a fatty alcohol containing from about 8 to about 14 carbon atoms ethoxylated with from about 2 to about 10 moles of ethylene oxide per mole of fatty alcohol.

3. The composition of claim 2 wherein said nonionic detergent surfactant has an HLB of from about 7 to about 14.

4. The composition of claim 3 containing from about 1% to about 15% of said hydrophobic solvent.

5. The composition of claim 4 wherein said hydrophobic solvent (b) is selected from the group consisting of tripropylene glycol monomethyl ether, tripropylene glycol monobutyl ether, and mixtures thereof.

6. The composition of claim 5 wherein said hydrophobic solvent (b) is tripropylene glycol monobutyl ether.

7. The composition of claim 5 containing a suds control system comprising from about 0.01% to about 0.2% of fatty acid and from about 0.1% to about 2.5% of anionic detergent surfactant, the ratio of anionic detergent surfactant to fatty acid being from about 15:1 to about 5:1.

8. The composition of claim 7 wherein said anionic detergent surfactant is selected from the group consisting of paraffin sulfonates, alkyl benzene sulfonates, and alkyl ethoxylate sulfates.

9. The composition of claim 8 wherein said fatty acid is derived from coconut oil.

10. The composition of claim 1 wherein said nonionic detergent surfactant is present at a level of from about 1% to about 5% and is selected from the group consisting of ethoxylated fatty alcohol containing containing an alkyl group containing from about 8 to about 22 carbon atoms, and ethoxylated alkyl phenol containing an alkyl group containing from about 8 to about 22 carbon atoms, and mixtures thereof, said nonionic detergent surfactant having an HLB of from about 6 to about 18.

11. The composition of claim 10 wherein said nonionic detergent surfactant is a fatty alcohol containing from about 8 to about 14 carbon atoms ethoxylated with from about 2 to about 10 moles of ethylene oxide per mole of fatty alcohol.

12. The composition of claim 11 wherein said nonionic detergent surfactant has an HLB of from about 7 to about 14.

13. The composition of claim 10 containing from about 1% to about 15% of said hydrophobic solvent (b).

14. The composition of claim 10 wherein said hydrophobic solvent (b) is selected from the group consisting of tripropylene glycol monomethyl ether, tripropylene glycol monobutyl ether, and mixtures thereof.

15. The composition of claim 10 containing from about 0.1% to about 15% of a polycarboxylate detergent builder selected from the group consisting of alkali metal citrates, detergent builders that have the formula:

$$R^5\text{-}[O\text{-}CH(COOH)CH(COOH)]_n R^5$$

wherein each R5 is selected from the group consisting of H and OH and n is a number from about 2 to about 3 on the average, and mixtures thereof.

16. The composition of claim 1 containing a zwitterionic detergent surfactant at a level of from about 0.2% to about 0.5%; a level of said nonionic detergent surfactant of from about 0.5% to about 6%; a level of said hydrophobic solvent of from about 2% to about 12%; and a level of polycarboxylate detergent builder of from about 0.2% to about 10%; and the pH of said composition being from about 6 to about 12.

17. The process of cleaning no-wax vinyl flooring comprising diluting the composition of claim 1 to give a level of said nonionic detergent surfactant (a) of from about 0.02% to about 0.12% and a level of said hydrophobic solvent (b) of from about 0.03% to about 0.2% and using said diluted composition to clean said flooring.

18. The process of claim 17 wherein said flooring is nearly new and said process does not comprise a rinsing step.

* * * * *